US009226602B2

(12) United States Patent
Pollard

(10) Patent No.: US 9,226,602 B2
(45) Date of Patent: Jan. 5, 2016

(54) DEVICE AND METHOD FOR DISPLAYING AND SELLING GOLF BALL MARKERS

(76) Inventor: Owen Craig Pollard, San Marcos, CA (US)

( * ) Notice: Subject to any disclaimer, the term of this patent is extended or adjusted under 35 U.S.C. 154(b) by 238 days.

(21) Appl. No.: 13/589,476

(22) Filed: Aug. 20, 2012

(65) Prior Publication Data

US 2014/0048501 A1 Feb. 20, 2014

(51) Int. Cl.

| | |
|---|---|
| ***A47F 7/00*** | (2006.01) |
| *A47F 5/02* | (2006.01) |
| *A63B 57/00* | (2015.01) |

(52) U.S. Cl.

CPC ..... *A47F 7/0042* (2013.01); *A47F 7/0057* (2013.01); *A47F 5/02* (2013.01); *A63B 57/0075* (2013.01)

(58) Field of Classification Search

CPC ..... A47F 7/0042; A47F 7/0057; A47F 5/02; A47G 1/12; A63B 57/00; A63B 57/0075; A63B 57/0068

USPC ..... 211/78, 85.7, 70.2, 14, 163; 206/315.1; D21/793, 794, 796; D6/680

See application file for complete search history.

(56) References Cited

U.S. PATENT DOCUMENTS

| | | | | | |
|---|---|---|---|---|---|
| 1,201,441 | A | * | 10/1916 | Clinger | 211/14 |
| 1,595,449 | A | * | 8/1926 | Carrm | 211/1.53 |
| 4,103,773 | A | * | 8/1978 | Haber | 206/315.9 |
| 4,730,728 | A | * | 3/1988 | Larkin | 206/315.9 |
| 5,234,114 | A | * | 8/1993 | Coffey | 211/70.2 |
| 5,551,832 | A | * | 9/1996 | Kelly | 414/788 |
| 5,603,175 | A | * | 2/1997 | Brenner | 40/124.4 |
| 5,628,396 | A | * | 5/1997 | Weiner | 206/216 |
| 5,715,947 | A | * | 2/1998 | Gonzales | 211/14 |
| 5,746,332 | A | * | 5/1998 | Kleinschmidt | 211/153 |
| D405,293 | S | * | 2/1999 | Tate | D6/457 |
| 5,984,112 | A | * | 11/1999 | Adams | 211/14 |
| 6,360,464 | B1 | * | 3/2002 | Tate | 40/621 |
| 6,739,462 | B1 | * | 5/2004 | Kelly | 211/163 |
| 6,742,982 | B2 | * | 6/2004 | Kelly | 414/791.5 |
| D524,381 | S | * | 7/2006 | Thompson | D21/478 |
| D617,578 | S | * | 6/2010 | Jee et al. | D6/455 |
| 2002/0108286 | A1 | * | 8/2002 | Brockley et al. | 40/800 |
| 2005/0042071 | A1 | * | 2/2005 | Kelly | 414/754 |
| 2006/0032097 | A1 | * | 2/2006 | Cope | 40/600 |
| 2008/0257756 | A1 | * | 10/2008 | Oakley | 206/83 |

* cited by examiner

*Primary Examiner* — Patrick Hawn

(74) *Attorney, Agent, or Firm* — John R. Ross, III; John R. Ross

(57) ABSTRACT

A golf ball marker display device. At least one display face includes a plurality of reclined cavities that are cut into the display face. Each of the reclined cavities includes a finger access area. Each reclined cavity holds a plurality of golf ball markers in a fashion such that as the front most golf ball marker is removed the remaining golf ball markers remain stacked in an orderly presentation. A golf ball marker is removed by fingers reaching into the finger access area, grabbing the golf ball marker and then removing the golf ball marker from the reclined cavity. In a preferred embodiment there are four display faces arranged in the general shape of a pyramid to form a pyramid display face. The pyramid display face is preferably rigidly connected to a rotating base.

12 Claims, 8 Drawing Sheets

DEVICE AND METHOD FOR DISPLAYING AND SELLING GOLF BALL MARKERS

The present invention relates to display stands, and in particular, to display stands for golf accessories.

BACKGROUND OF THE INVENTION

Golfers of all levels of play are very interested in acquiring the necessary equipment for the game. There are many accessories needed to properly play the game of golf. In addition to a set of clubs and golf balls, a golfer will need other items such as tees, a divot repair tool and at least one golf ball marker.

Throughout the years golfers have used various types of golf ball markers. Some golfers have used a plastic marker with a pin that helps hold the marker in place on the putting green. Other golfers have merely used a penny or dime to mark their ball's position. In recent years it has become more popular for a golfer to use a more attractive and decorative ball marker. For example, FIG. 1 shows prior art ball marker 21. Ball marker 21 is typically about the size of a quarter, it contains magnetic material such as iron, nickel or cobalt and it is decorated with the emblem of a popular professional sports team. Its magnetic properties allow it to be attached to a magnet contained in a golf ball marker hat clip of the golfer.

Due to the visual appeal of golf ball markers, golfers have become more interested in their purchase. Some golfers even collect multiple golf ball markers of their favorite sports teams or the favorite golf courses. This means that there is good potential for strong sales of golf ball markers. However, the prior art method of displaying golf ball markers has been inadequate and has actually hampered sales of the markers. For example, in the prior art, golf ball markers have been kept in a closed case or behind the cash register operator and away from the consumer's hands in an effort to curtail theft. Unfortunately, this method of display has also hurt sales because the consumer is not given easy access to the markers to properly evaluate them for purchase. What is needed is a better display device for displaying golf ball markers.

SUMMARY OF THE INVENTION

The present invention provides a golf ball marker display device. At least one display face includes a plurality of reclined cavities that are cut into the display face. Each of the reclined cavities includes a finger access area. Each reclined cavity holds a plurality of golf ball markers in a fashion such that as the front most golf ball marker is removed the remaining golf ball markers remain stacked in an orderly presentation. A golf ball marker is removed by fingers reaching into the finger access area, grabbing the golf ball marker and then removing the golf ball marker from the reclined cavity. In a preferred embodiment there are four display faces arranged in the general shape of a pyramid to form a pyramid display face. The pyramid display face is preferably rigidly connected to a rotating base.

DETAILED DESCRIPTION OF PREFERRED EMBODIMENTS OF THE PRESENT INVENTION

Figure 2:
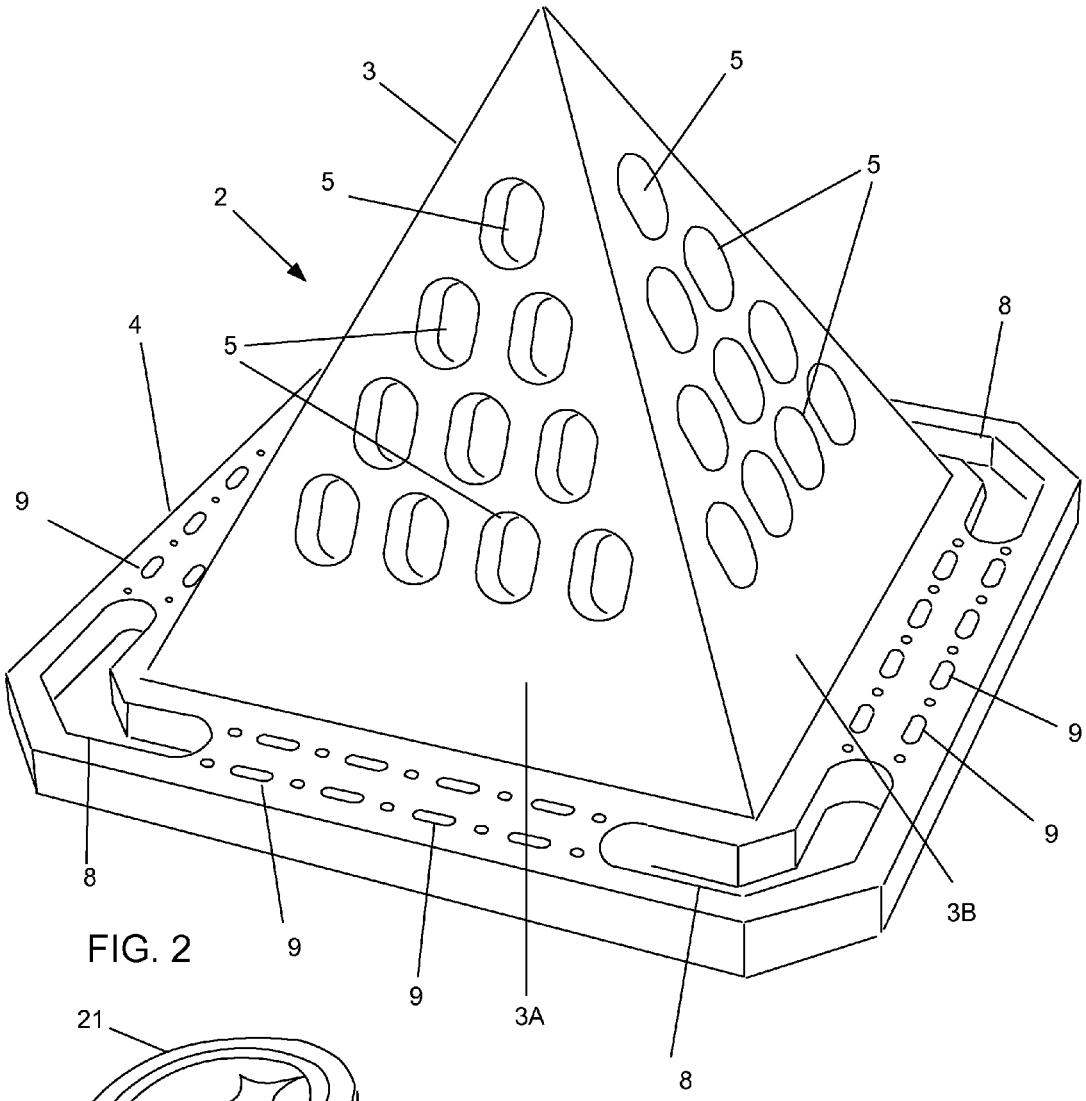
FIG. 2 shows a preferred embodiment of the present invention.
Figure 1:
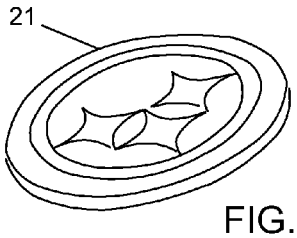
PRIOR ART FIG. 1
FIG. 1 shows a prior art golf ball marker.

FIG. 2 shows a preferred embodiment of the present invention. Rotatable ball marker display stand 2 includes upper pyramid 3 and base 4. Pyramid 3 includes display faces 3A-3D (see also FIG. 3). Pyramid 3 includes multiple golf ball marker holders 5. Each golf ball marker holder 5 preferably holds up to 10 golf ball markers. Pyramid 3 preferably includes 40 golf ball marker holders 5. Therefore, preferably rotatable golf ball marker display stand 2 holds 400 golf ball markers.

Base 4 includes multiple golf accessory holders 8 and 9 that are preferably utilized for holding other golf accessory items such as golf tees, golf divot repair tools, and magnetic golf ball marker hat clips.

In a preferred embodiment of the present invention, display stand 2 is purchased by a retailer sporting goods store or golf pro shop that sells golf related items. Display stand 2 is preferably positioned near the cash register. A consumer preferably will pass by display stand 2 on his way to the cash register. Golf ball markers 21 are stacked inside golf ball marker holders 5. The consumer is preferably free to touch and handle display stand 2 and the multiple ball markers 21. He may then pick the ball marker(s) that he prefers for purchase. He may also pick other golf accessories, such as golf tees, divot repair tools or magnetic golf ball marker hat clips if he wishes.

Display Stand

Figure 3:
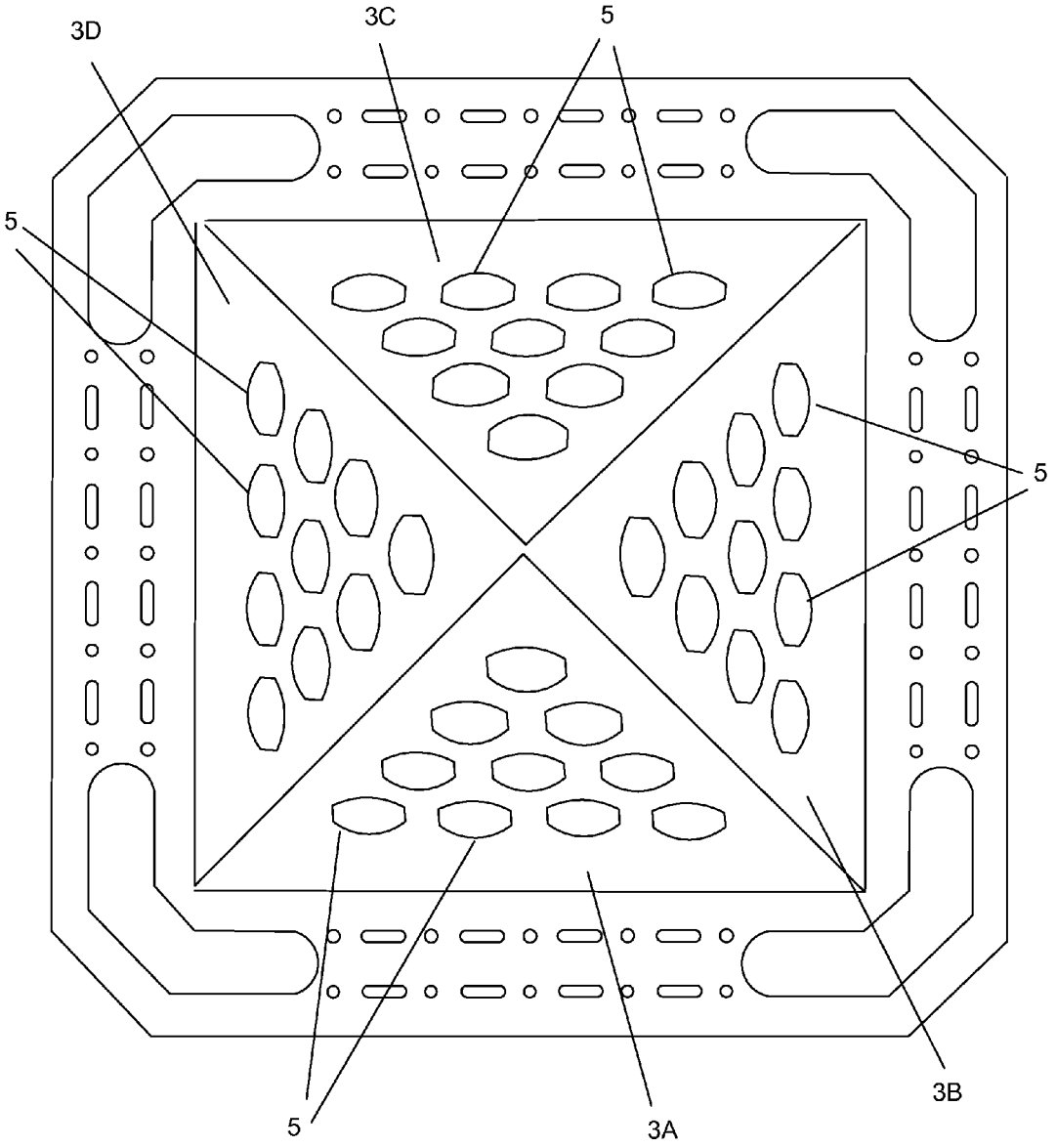
FIG. 3 shows a top view of a preferred embodiment of the present invention.

FIG. 3 shows a top view of display stand 2. Pyramid 3 has 40 golf ball marker holders 5 and is rigidly connected to rotatable base 4.

Rotatable Base

Figure 4:
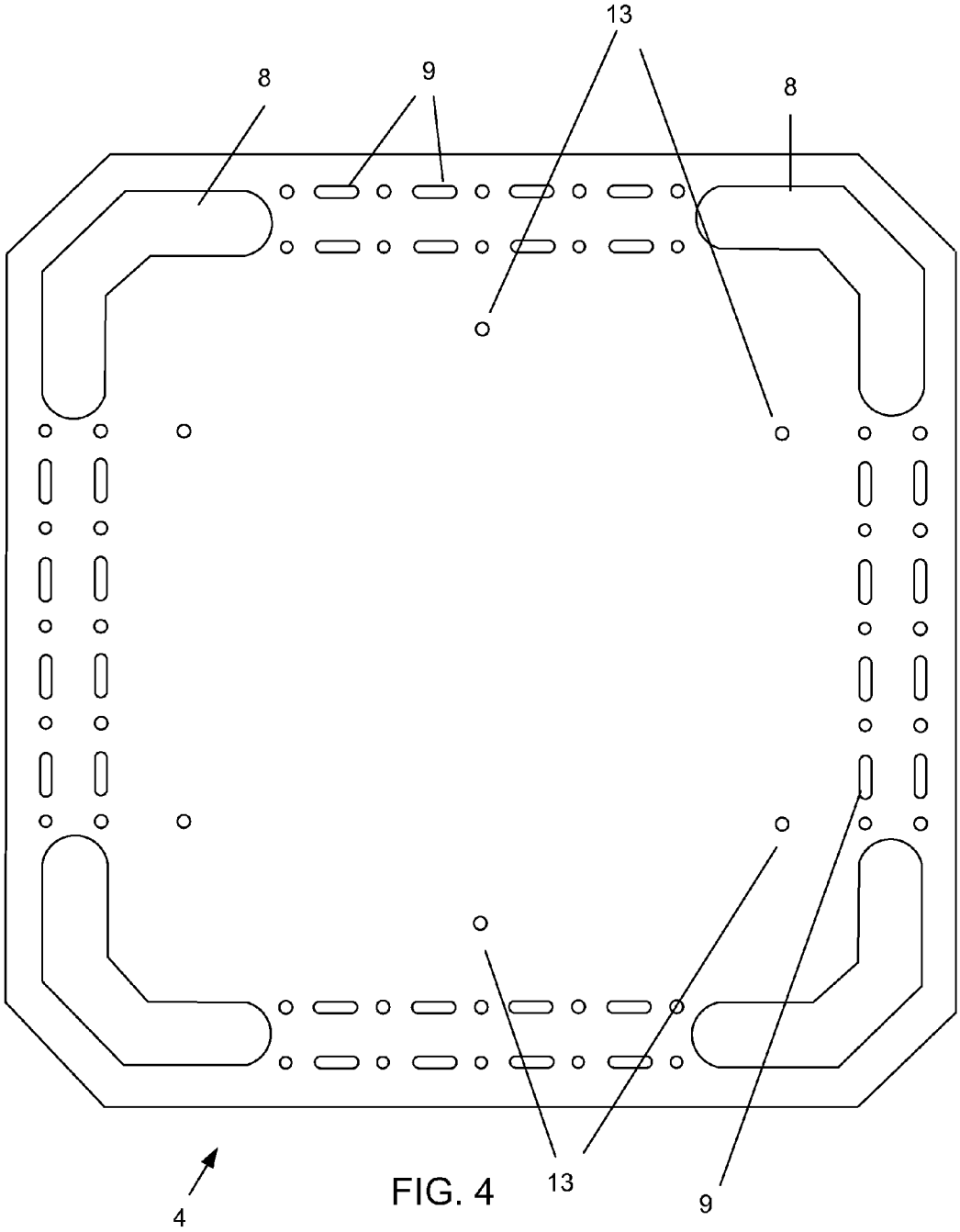
FIG. 4 shows a top view of a preferred base.

FIG. 4 shows a top view of base 4. Preferably, base 4 is fabricated from plastic utilizing a Computer Numerical Control (CNC) routing process. Base 4 has a thickness of approximately 1 inch. Golf accessory holders 8 and 9 are preferably shaped as shown and have a depth of approximately ¾ inch. Screw holes 13 extend through base 4 as shown.

Figure 5:
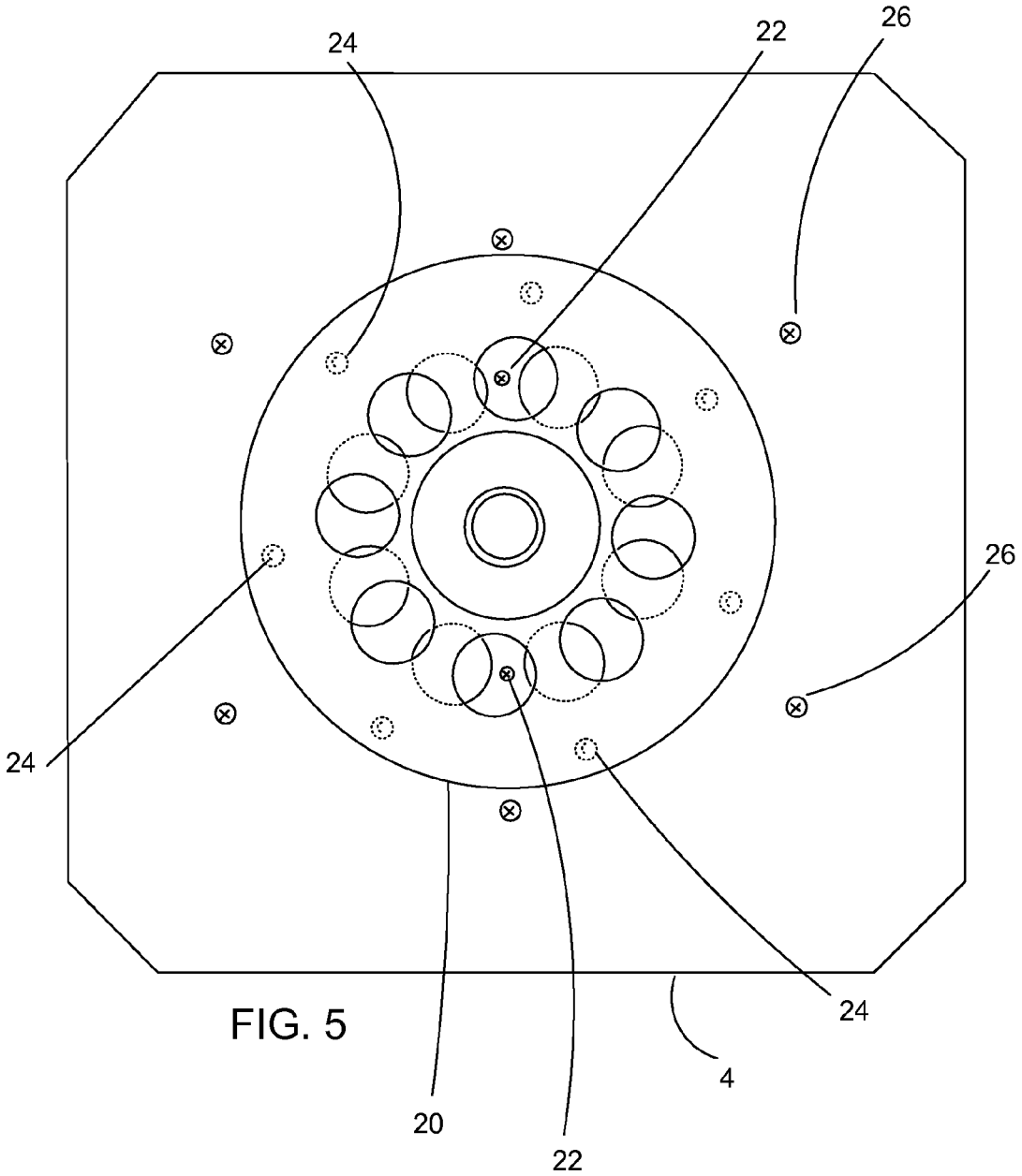
FIG. 5 shows a bottom view of a preferred base.

FIG. 5 shows a bottom view of base 4. Rotation platform 20 is rigidly connected to base 4 via screws 22. Base 4 rotates freely on ball bearings 24 of rotation platform 20. Screws 26 are utilized to connect base 4 to pyramid top 3 via predrilled screw holes 28 (FIG. 6).

Pyramid Top

Figure 6:
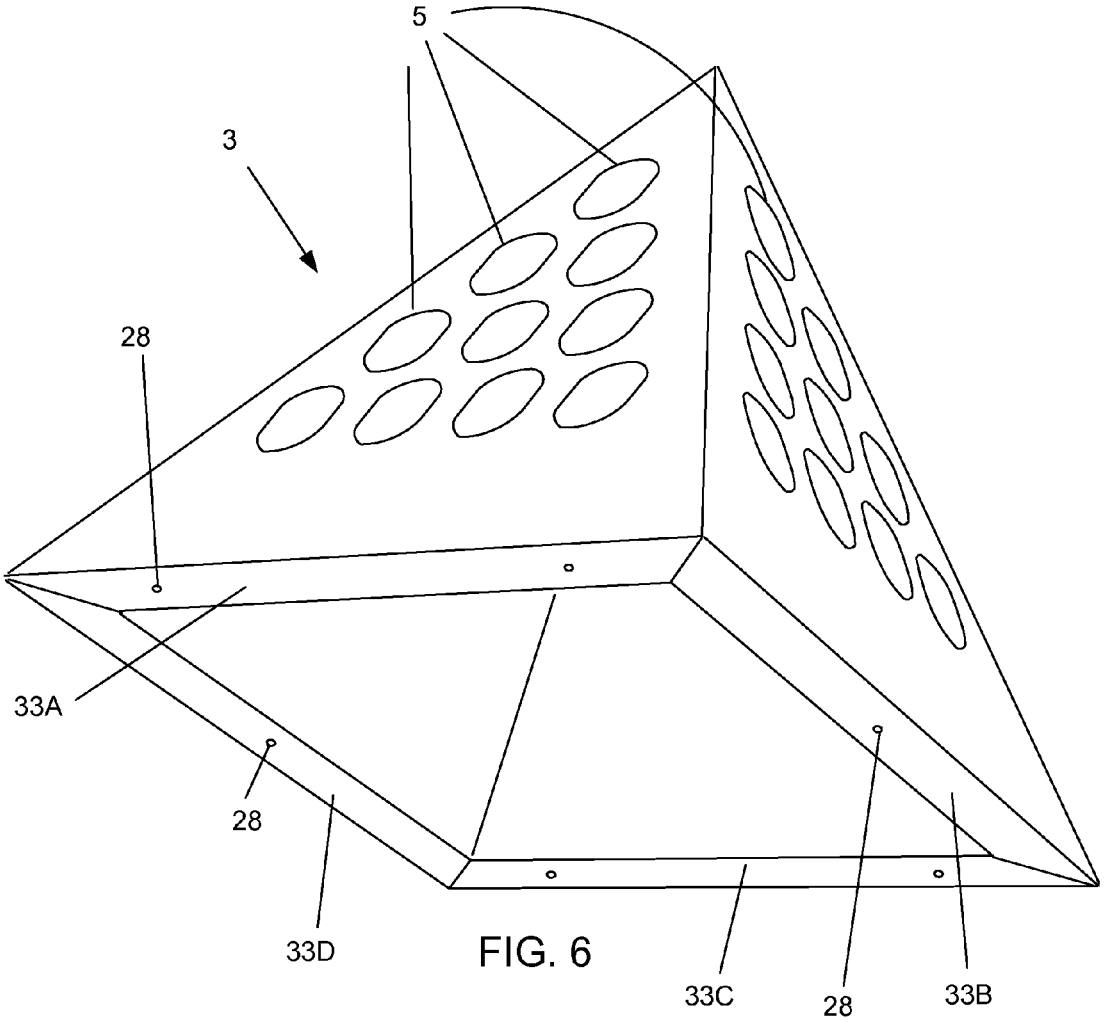
FIG. 6 shows a preferred pyramid.

FIG. 6 shows pyramid top 3. Pyramid top 3 includes four identical sides 33A-33D. Each side 33A-33D is preferably fabricated utilizing a CNC routing process. The sides are then glued together as shown. Pyramid top 3 includes 40 golf ball marker holders 5. Pyramid top 3 includes predrilled screw holes 28, as shown. Screw holes 28 match screw holes 13 of base 4 (FIG. 4).

Golf Ball Marker Holders

Figure 7:
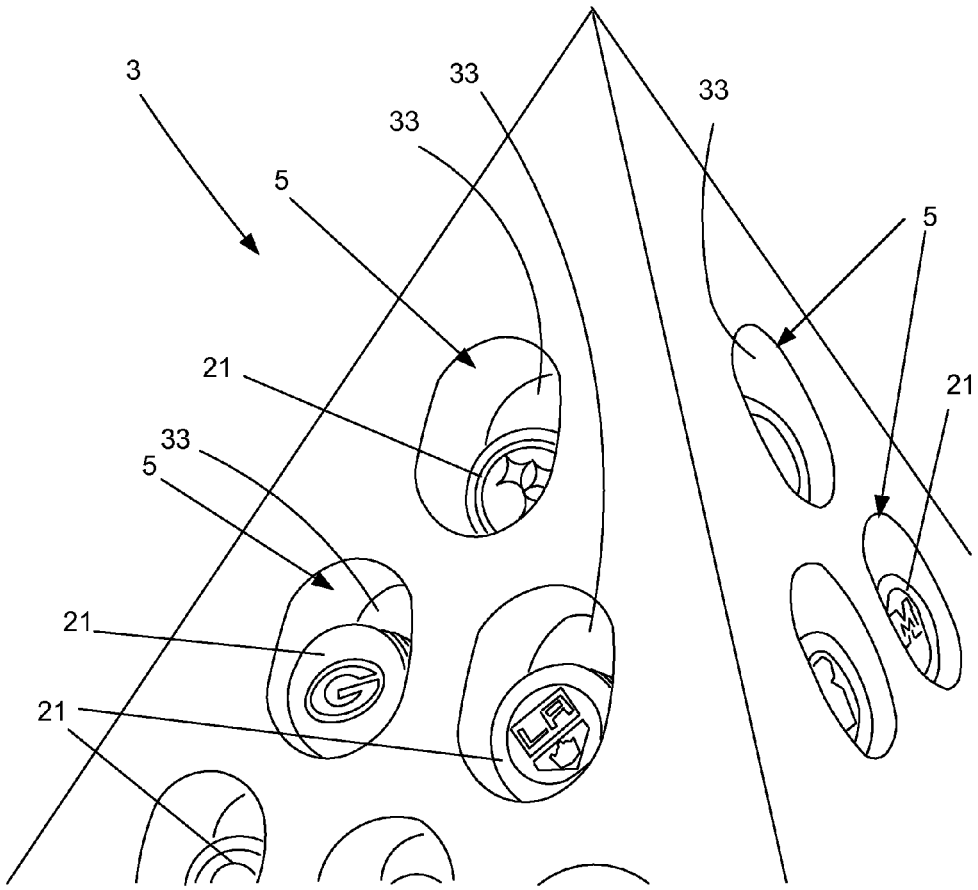
FIG. 7 shows preferred ball marker holders.
Figure 8:
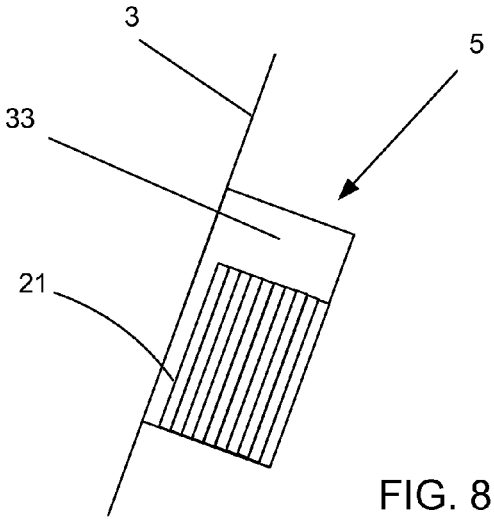
FIG. 8 shows a side view of a preferred ball marker holder.

FIG. 7 shows a close up view of golf ball marker holders 5 holding golf ball markers 21. FIG. 8 shows a side view of a single golf ball maker holder 5 holding 10 golf ball markers 21. In a preferred embodiment golf ball marker holder 5 is a reclined cavity and has a depth of approximately ¾ inch, a width of approximately 1 inch and a height of approximately 1⅜ inch. The top and bottom of golf ball marker holder 5 are rounded. The bottom of golf ball marker 5 conforms to the shape of golf ball marker 21, as shown. It should be noted that each golf ball marker holder 5 includes a finger access area 33 at its top. The finger access area allows for a consumer to remove the top golf ball marker 21 from golf ball marker holder 5. It should also be noted that golf ball marker holder 5 is reclined backwards. This allows for the golf ball markers in each holder 5 to stay properly aligned and stacked, even as the front most marker 21 is removed by the consumer.

Utilization of a Preferred Golf Ball Marker Display Stand

In a preferred embodiment of the present invention, display stand 2 (FIG. 2) is purchased by a sporting goods store or golf pro shop that sells golf related items. In a preferred embodiment, the purchased display stand includes at least 400 golf ball markers. Each golf ball marker holder 5 can hold at least 10 stacked golf ball markers. The display stand is preferably positioned so that it is near the cash register and in view of the cash register operator. Display stand 2 is preferably position so that the consumer can physically touch and handle the display stand as well as the ball markers held by the display stand. As the consumer is making his purchase, or as the golfer is paying for his tee time, he will see display stand 2 and the golf ball markers held by the display stand. Because display stand 2 and the golf ball markers are easily accessible to the consumer, he will very inclined to focus on the ball markers in the display stand and inclined to make a purchase. The consumer is much more likely to purchase a ball marker if the ball marker is displayed as shown in FIG. 2 than if the ball marker is positioned in a manner as taught by the prior art. Indeed, Applicant has sold many display stands 2 to retailers and has had very positive feedback reporting a dramatic increase in purchases of golf ball markers.

Another Preferred Embodiment of the Present Invention

Figure 9:
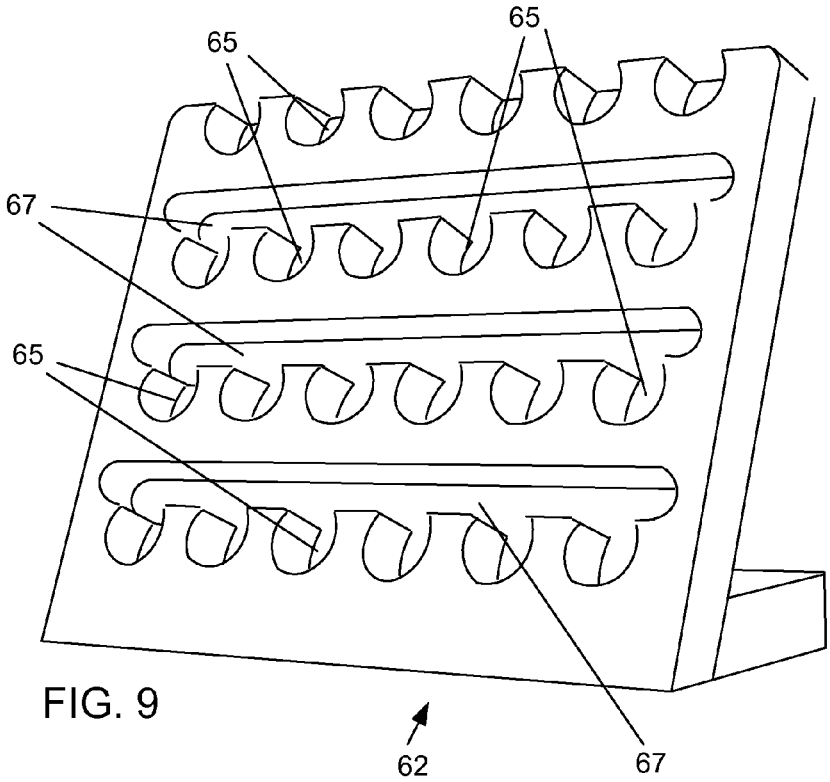
FIGS. 9-11 show another preferred embodiment of the present invention.
Figure 10:
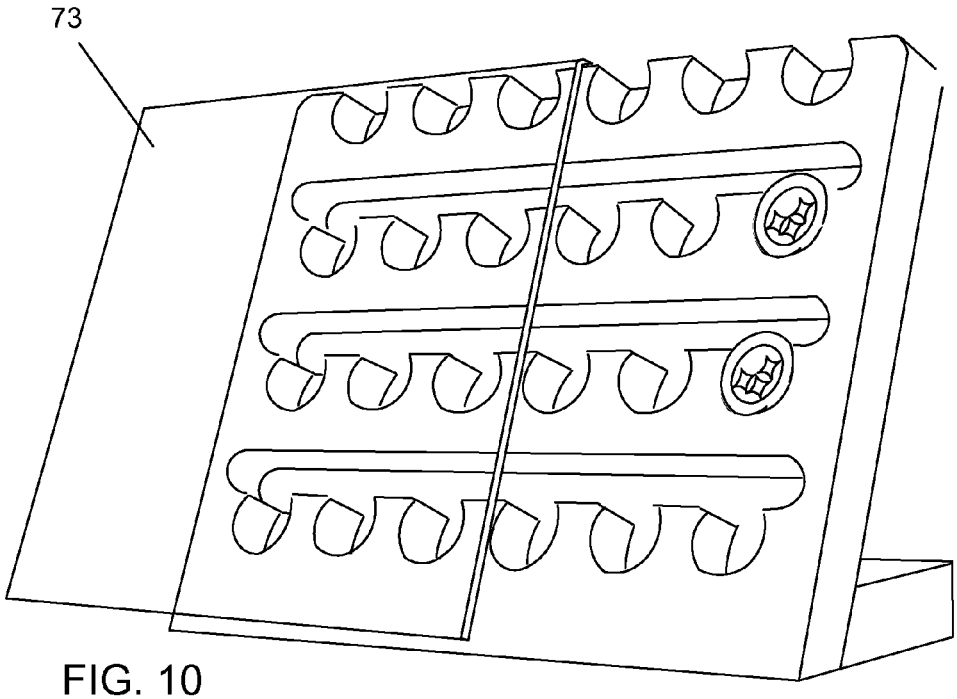
Figure 11:
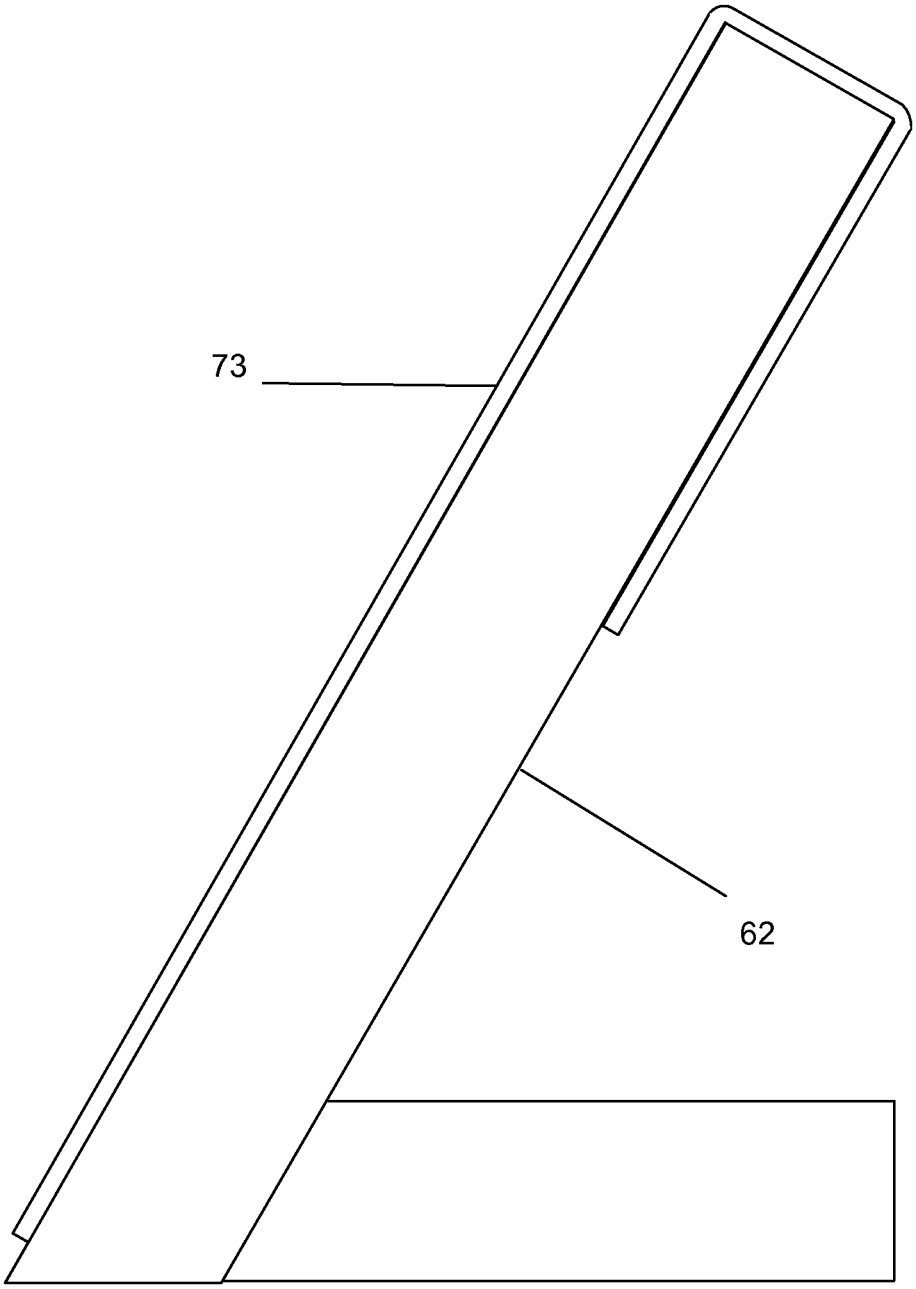

FIGS. 9-11 show another preferred embodiment of the present invention. Golf ball marker display stand 62 includes twenty-four golf ball marker holders 65. The bottom three rows include finger access area 67. The top row holds the ball markers over the top of display stand 62. As with the earlier described preferred embodiment shown in FIG. 2, ball marker holders 62 are reclined backwards so that the ball markers stay properly aligned and stacked, even as the front most marker 21 is removed by the consumer. Preferably, display stand 62 includes slidable security shield 73 fabricated from clear see through plastic. Security shield 73 is normally positioned so that it completely covers all the ball markers displayed in display stand 62. When a consumer sees a ball marker he likes, he can easily slide the shield to expose the ball marker of interest (FIG. 10). The consumer then can remove the ball marker with his fingers. Then, the consumer can slide security shield back over so that all ball markers are covered once again. FIG. 11 shows a side view of display stand 62 and security shield 73.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention

What is claimed is:

1. A golf ball marker display device comprising at least one display face having a plurality of reclined cavities, said plurality of reclined cavities cut into said at least one display face, each cavity being adapted to hold a plurality of golf ball markers, wherein each cavity comprises a finger access region permitting removal of a front most golf ball marker while the remaining golf ball markers remain stacked, wherein each cavity comprises a rounded bottom to conform to the shape of the golf ball markers, wherein each cavity comprises sides, wherein each cavity comprises a flat back, wherein said rounded bottom, said sides and said flat back operate to ensure that the golf ball markers stay properly aligned and stacked, even as a front most golf ball marker is removed.

2. The golf ball marker display device as in claim 1, wherein said at least one display face is a plurality of display faces.

3. The golf ball marker display device as in claim 1, wherein said at least one display face is four display faces arranged in the general shape of a pyramid to form a pyramid shaped display face.

4. The golf ball marker display device as in claim 3, wherein said plurality of reclined cavities is 40 reclined cavities, wherein each reclined cavity holds up to 10 golf ball markers.

5. The golf ball marker display device as in claim 1 further comprising golf accessory holders for holding golf tees, divot repair tools and magnetic golf ball marker hat clips.

6. The golf ball marker display device as in claim 3 further comprising a rotatable base positioned at the bottom of said pyramid shaped display face.

7. The golf ball marker display device as in claim 6, wherein said rotatable base further comprises golf accessory holders for holding golf tees, divot repair tools and magnetic golf ball marker hat clips.

8. The golf ball marker display device as in claim 1, further comprising a transparent security shield positioned over said at least one display face.

9. The golf ball marker display device as in claim 1, wherein said transparent security shield is slidable.

10. The golf ball marker display device as in claim 1 wherein said display device is positioned in close proximity to a consumer so that the consumer can touch and handle said display device and said golf ball markers held by said display device.

11. The golf ball marker display device as in claim 1 wherein said flat back is reclined at an angle equal to the reclined angle of said at least one display face.

12. A method for selling golf ball markers held in a golf ball marker display device, comprising the steps of:

A) positioning said golf ball marker display device in close proximity to a consumer, said golf ball marker display device comprising at least one display face having a plurality of reclined cavities, said plurality of reclined cavities cut into said at least one display face, each cavity being adapted to hold a plurality of golf ball markers, wherein each cavity comprises a finger access region permitting removal of a front most golf ball marker while the remaining golf ball markers remain stacked wherein each cavity comprises a rounded bottom to conform to the shape of the golf ball markers, wherein each cavity comprises sides, wherein each cavity comprises a flat back, wherein said rounded bottom, said sides and said flat back operate to ensure that the golf ball markers stay properly aligned and stacked, even as a front most golf ball marker is removed, B) reaching into said finger access area, C) grabbing said front most golf ball marker, and D) removing said front most golf ball marker from said reclined cavity, E) purchasing said golf ball marker.

* * * * *